US006761773B1

(12) United States Patent
McKechnie et al.

(10) Patent No.: US 6,761,773 B1
(45) Date of Patent: Jul. 13, 2004

(54) METHOD FOR CONTROLLING AND REMOVING DUST AND OTHER PARTICLES FROM A MATERIAL

(75) Inventors: Malcolm Tom McKechnie, Driffield (GB); Paul Terence Gaynor, Portswood (GB); John Farrell Hughes, Bartley (GB); Jonathan Swingler, Netley Abbey (GB)

(73) Assignees: Southampton University, Southampton (GB); Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/308,860

(22) PCT Filed: Dec. 3, 1997

(86) PCT No.: PCT/GB97/03317

§ 371 (c)(1),
(2), (4) Date: Jan. 12, 2001

(87) PCT Pub. No.: WO98/24356

PCT Pub. Date: Jun. 11, 1998

(30) Foreign Application Priority Data

Dec. 4, 1996 (GB) ..... 9625664
Sep. 5, 1997 (GB) ..... 9718934

(51) Int. Cl.[7] ..... B08B 6/00
(52) U.S. Cl. ..... 134/1; 134/6; 134/7; 15/1.51
(58) Field of Search ..... 134/1, 6, 7; 15/1.51; 427/457, 458, 475, 180, 195; 118/600; 239/690, 690.1, 706

(56) References Cited

U.S. PATENT DOCUMENTS 4,268,935 A 5/1981 Bessinger ..... 15/320
4,751,759 A 6/1988 Zoell ..... 15/1.5 R
5,490,300 A 2/1996 Horn ..... 15/1.51
5,753,302 A * 5/1998 Sun et al. ..... 118/308
5,765,761 A * 6/1998 Law et al. ..... 239/690.1
5,800,605 A * 9/1998 Hughes ..... 106/270
5,865,381 A * 2/1999 Mitsumura et al. ..... 241/162

FOREIGN PATENT DOCUMENTS

EP 769031 * 4/1997
WO WO 96/01285 * 1/1996
WO WO96/23440 8/1996 ..... A47L/9/00

OTHER PUBLICATIONS

Copy of PCT International Search Report for PCT/GB97/03317 dated Apr. 8, 1998.

* cited by examiner

*Primary Examiner*—Alexander Markoff
(74) *Attorney, Agent, or Firm*—Fish & Richardson P.C.

(57) ABSTRACT

A method for controlling and removing dust and other fine particles in a material comprising i) electrostatically charging carrier particles in powder form to give the carrier particles a minimum charge to mass ratio of $+/-1\times10^{-4}$ C/kg, ii) delivering the electrostatical charged carrier particles to the material, whereby the dust and other fine particles in the material agglomerate with the charged carrier particles and iii) removing the resultant agglomerates from the material (for example by vacuuming or brushing). An apparatus for delivering electrostatically charged particles to a material, the apparatus comprising a) a container, in which particles to be electrostatically charged are stoned and b) means for delivering the particles from the container to the carpet of fabric material, the delivery means comprising i) a tube or pipe for delivering the carrier particles to the carpet or fine fabric material; and ii) means for expelling particles at high velocity from the container to the material; the tube or pipe being made of such a material that, when carrier particles are passed down the de tube at high velocity, a minimum charge to mass ratio of $+/-1\times10^{-4}$C/kg is imparted to the particles by the frictional contact of the particles on the inside of the tube or pipe.

20 Claims, 5 Drawing Sheets

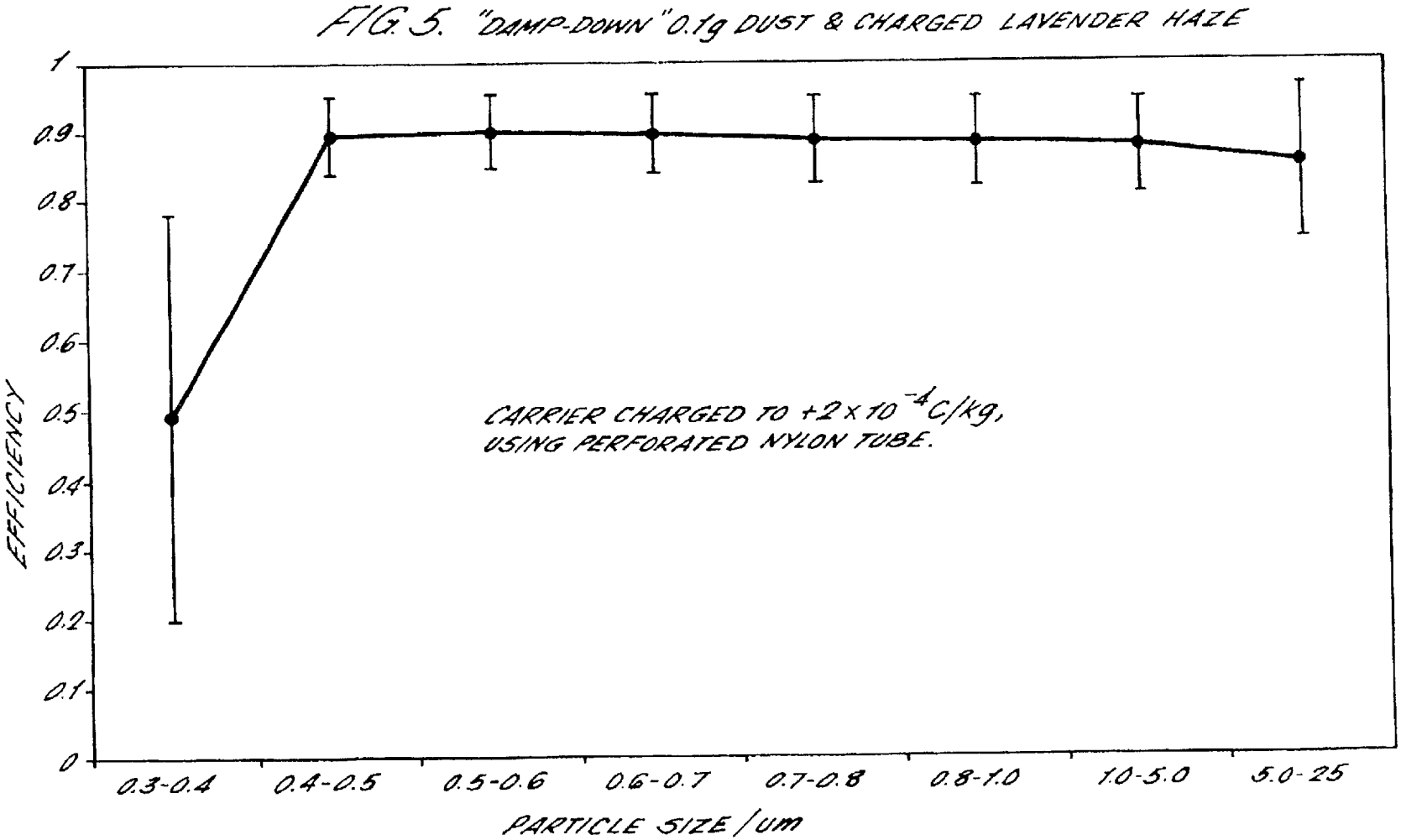
FIG. 5. "DAMP-DOWN" 0.1g DUST & CHARGED LAVENDER HAZE
CARRIER CHARGED TO +2 X TO -4 C/kg,
USING PERFORATED NYLON TUBE.
EFFICIENCY
1
0.9
0.8
0.7
0.6
0.5
0.4
0.3
0.2
0.1
0
0.3-0.4
0.4-0.5
0.5-0.6
0.6-0.7
0.7-0.8
0.8-1.0
1.0-5.0
5.0-25
PARTICLE SIZE/um

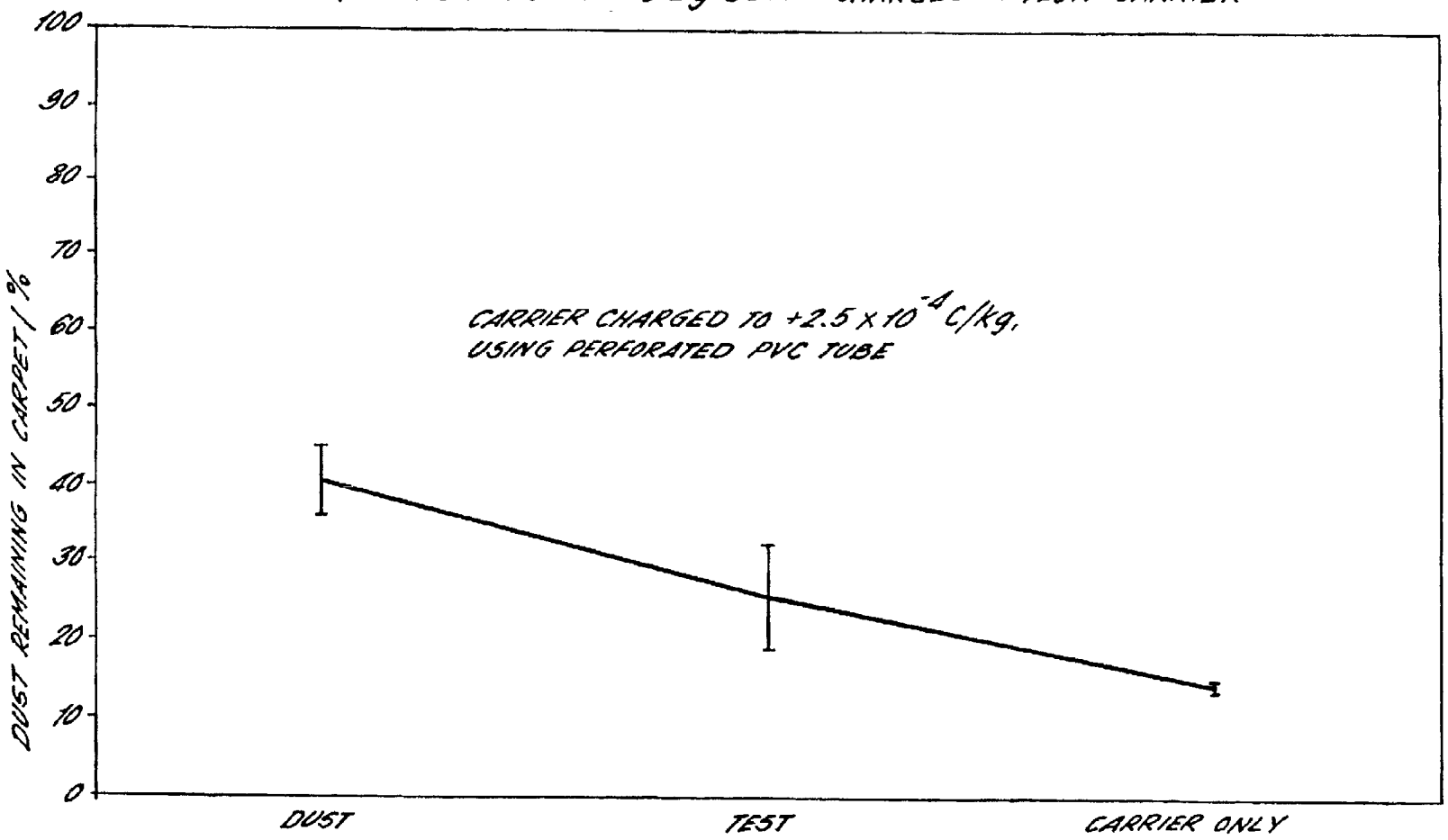
FIG. 6. "MOP-UP" 0.2g DUST & CHARGED NYLON CARRIER
CARRIER CHARGED TO +2.5 x 10^-4 C/kg.
USING PERFORATED PVC TUBE
DUST REMAINING IN CARPET / %
100
90
80
70
60
50
40
30
20
10
0
DUST
TEST
CARRIER ONLY

METHOD FOR CONTROLLING AND REMOVING DUST AND OTHER PARTICLES FROM A MATERIAL

BACKGROUND OF THE INVENTION

The present invention relates to a method for removing dust and particles, which may include allergens, found in carpet and fine fabric material as well as to an apparatus for delivering electrostatically charged particles to the said material.

The invention, we believe functions, by the dust and fine particles agglomerating with electrostatically charged particles, after which the resulting agglomerates can be removed, for example by vacuuming.

It is well known to remove dust and fine particles from carpets by vacuuming. Although most commercial vacuum cleaners will remove some dust and fine particles from carpets, there will always be some fine dust particles left in the carpet that due to their size cannot be sucked into the vacuum cleaner. It is normally the very fine particles which are the most difficult to remove. Particles below 10 $\mu$m in diameter, commonly called $PM_{10}$s, which are lodged deep in the carpet pile near the backing, are always difficult to remove efficiently. It is these particles that are considered to be most hazardous in terms of health implications.

In addition even those $PM_{10}$s which are removed by the vacuum cleaner may well not be retained in the vacuum cleaner filter and may therefore subsequently be released into the atmosphere through the filtration system of the vacuum cleaner. As a result it is often necessary to have special filter bags to retain the dust and fine particles actually in the vacuum cleaner.

During vacuum cleaning of such materials as carpets, those particles which are not removed have a tendency to be disturbed and thus become airborne. Thus a high level of airborne particles (which may include allergens) may occur. Particles of up to 10 $\mu$m in diameter can remain airborne for long periods of time and are small enough to be inhaled into the human respiratory system. In this way, the faeces of the house dust mite (Dermatophagoides pteronyssinus or Dermatophagoides farinae)—now recognised as the most common allergen carrier associated with asthma, enters the respiratory system. These allergens are known as known as the Der p and Der f allergen series. In addition, the feline allergen (Fel d series) can also be transmitted to the respiratory system.

It is an aim of the present invention to provide an improved method and apparatus for controlling and removing dust and other fine particles, especially the Der f and Der p allergens in, for example, a carpet.

It is a further aim of the present invention to provide an improved method of dispensing charged particles to a surface.

SUMMARY AND GENERAL DISCLOSURE

According to one aspect of the present invention there is provided a method for controlling and removing dust and other fine particles in a material, such as a carpet or fine fabric material, comprising i) electrostatically charging carrier particles (for example by tribo-electric charging, induction charging or corona charging) in powder form to give the carrier particles a minimum charge to mass ratio of $+/-1\times10^{-4}$ C/kg, ii) delivering the electrostatically charged carrier particles to the material, whereby the dust and other fine particles in the material agglomerate with the charged carrier particles and iii) removing the resultant agglomerates from the material.

The agglomerates can be removed from the carpet or other material by a vacuum cleaning process or by a brush. The agglomerates, which are significantly larger than individual dust particles, will be easier to remove by vacuum cleaning, especially where the cleaning process includes mechanical agitation and vacuum suction.

In addition, the agglomerates are less likely to become airborne than the individual dust particles and certainly will not be able to remain airborne for long periods of time. In addition, once the small particles ($PM_{10}$s) are in a vacuum cleaner as a component of the agglomerates, their escape through the filtration system of the vacuum cleaner will likewise be significantly reduced.

Where the material to be treated is a carpet, the charged carrier particles penetrate right down to the backing of the carpet and attract dust and other fine particles from the depths of the carpet, so that these can also be removed more efficiently.

The carrier particles used in the method of the invention may be electrostatically charged as they are being applied to the carpet or other material. For example, the carrier particles may be stored in the container or a device having a delivery system which is designed so that on delivery an electrostatic charge is imparted, eg by tribo-electric charging, to the particles.

In such an apparatus the carrier particles will become charged as they are expelled through the delivery system onto the carpet or other material.

Alternatively, the carrier particles may be charged and stored in a container before they are applied to the carpet or other material. A process for the preparation of electrostatically charged particles of a high resistivity is described in European Patent Application No. 95921916.3. The already charged particles are then delivered from the container and applied directly to the carpet or other material.

The electrostatically charged carrier particles are preferably powder particles formed from compounds selected from celite, maize, cyclodextrin, polyvinylpyrrolidone, polyester, nylon, calcite treated with oils, polyvinyl chloride (PVC), polytetra fluoroethylene, polystyrene, polycarbonate, polyimides, "immobilised tannic acid" (as defined below) and wax materials (such as a synthetic paraffin wax or a natural wax, for example Carnauba wax).

By the term "Immobilised tannic acid" as used herein is meant tannic acid immobilized on polyvinylpyrrolidone beads. "Immobilised Tannic Acid" is prepared as follows:

100 mg of tannic acid dissolved in water, 50 mg of Polyclar 10 (ISP, Guildford Sumg) polyvinylpyrrolidone beads were added and stirred for one hour. The beads were filtered from the solution and washed with a few mls of iced water until no colour was seen in the washings. They were then dried in an oven at 50° C.

The minimum level of charging required on the carrier particles is such as to provide a charge to mass ratio of $\pm1\times10^{-4}$ C/kg, although ratios in excess of $\pm1\times10^{-3}$ C/kg may be achieved using the charged particle application system hereinafter described with reference to FIGS. 2, 3 and 4 of the accompanying drawings.

The electrostatic charge on the carrier particle may be of positive or negative polarity, or may be a mixture of both when the particles are frictionally charged mixtures of different electrically insulating materials.

The charged particles used in the method of the invention preferably have a diameter in the range of from 10 to 500 $\mu$m, more preferably 100 to 300 $\mu$m.

In carrying out the method according to the invention, at the same time as (or after) the electrostatically charged carrier particles are applied to the material, the surface of the material is preferably agitated in order to ensure that the dust and small particles agglomerate with the charged carrier particles and are therefore captured. Agitation may be carried out at the same time as the electrostatically charged particles are delivered to the carpet, or as an intermediate agitation step between delivery of the electrostatically charged carrier particles and their final removal, or during the final removal step.

The method of the invention therefore enhances the removal of small particles from the carpet or other material ("Mop-Up"), restricts the number of particles becoming airborne during the removal of the small particles ("Damp-Down"), and increases the capacity of a vacuum cleaner to retain the small particles ("Stay-Put").

It has been found that the charging levels on the powder are increased when the velocity of the particles through the charging tube or pipe is increased. Generally the velocity of the particles being passed down the tube or pipe will be in the range of from 10 to 80 m/sec, preferably from 30 to 60 m/sec and more preferably 42 m/sec, in order to achieve the desired charge levels.

The length of the charging tube or pipe and the number and diameter of any apertures formed in the charging tube will also affect the charging levels on the powder. Generally the charging tube or pipe will have a length in the range of from 50 to 500 mm, preferably 100 mm to 300 mm. During the charging of the powder the air pressure in the charging tube is higher, than atmospheric pressure. The number, size and arrangement of any holes formed in the charging tube or pipe will preferably be such that continuous tribo-electric charging can occur without the holes allowing so much air to escape from the holes because of the pressure difference that the loss in air and powder velocity will reduce the level of triboelectric charge. Preferably, therefore, the holes will each have a diameter of less than 5 micrometres, more preferably from 2 to 3 micrometres in diameter. The holes may be of this size since electrical discharge through the holes does not require a large cross-sectional area.

It is possible to increase the amount of turbulence of the particles during charging and hence the contact of the particles with the surface of the tube or pipe by arranging for the particles to travel along a tortuous path. This may be achieved, for example, by arranging the tube or pipe in a non-linear fashion for example as a coil. When the tube or pipe is arranged in this manner, longer tubes or pipes are preferably used in order to maximise the contact of the powder with the surface thereof. For example tubes or pipes of up to 300 mm in length may be used.

An additional aspect of the present invention is that the powder may comprise a mixture of at least two different powdered materials which, on charging in the manner as previously described, will accept charges of opposite polarity. This system may be termed a bipolar system. The charging tube or pipe for a bipolar system does not require any discharge holes. The reason for this is that in a bipolar charged system that is balanced there should not be any net build up of charge on the inner surface of the tube or pipe which requires to be discharged. If the bipolar system is unbalanced and a net charge of one polarity builds up on the inner surface of the tube or pipe, this will act to dynamically limit and equalise the imbalance by providing extra charge for one powder and inhibiting charge transfer from the other powder.

Accordingly, in a further aspect the present invention provides a method of dispensing charged particles to a surface from a container which contains uncharged particles, which method comprises the steps of:

entraining the particles in a stream of gas;

directing the stream of gas and entrained particles through a tube or pipe capable of imparting to the particles a minimum charge to mass ratio of $+/-1\times10^{-4}$ C/kg, by frictional contact of the particles with the inner surface of the tube or pipe; and directing the stream of gas and entrained charged particles to a surface;

wherein a mixture of particles of at least two different materials is employed, the particles of a first material being capable of assuming, on charging, a charge of a particular polarity and the particles of a second material being capable of assuming, on charging, a charge of the opposite polarity to that of the first particles.

It will be appreciated that use of such a mixture of charged particles has particular advantages in controlling and removing dust and other fine particles in a material, for example, a carpet. This is because, in practice, the dust and other fine particles in the material will themselves be charged and will be attracted to a charged particle of opposite polarity directed onto the material. This has distinct advantages in both the "Mop-Up" and "Damp-Down" phases of removal of small particles from the material.

In a still further aspect the present invention provides a method of dispensing charged particles to a surface from a container which contains uncharged particles, which method comprises the steps of entraining the particles in a stream of gas;

directing the stream of gas and entrained particles through a tube or pipe capable of imparting to the particles a minimum charge to mass ratio of $+/-1\times10^{-4}$ C/kg, by frictional contact of the particles with the inner surface of the tube or pipe; and directing the stream of gas and entrained charged particles to a surface;

wherein the tube or pipe includes a plurality of holes therein which are dimensioned so as to allow for electrical discharge through the holes, without allowing gas flow through the holes to the extent that the velocity of the stream of gas which entrains the particles is substantially reduced.

Such methods of directing charged particles to a surface represent a significant improvement over the known art for particle delivery. In particular, the charged particles, especially those of higher charge, now experience a much higher rate of dispersion and have an increased ability to stick to surfaces to which they are delivered, including glass, ceramics, plastics, metals, skin and hair. In addition to this, the charged particles have an ability to stick to those parts of the surface to which they are directed which are not directly exposed to the charged particles and other inaccessible places, for example, around and behind cylinders such as glasses and bottles, behind door handles and the like and in-between and around toes and fingers. As such, the charged particles so delivered stick evenly on the surface avoiding build-up and uneven distribution of the charged particles on the surface. This has particular advantages when it is desired that a substantially even distribution of charged particle is required in a particular application, for example, delivery to a toilet bowl or rubbish bin.

It will be appreciated that this has particular advantages in the delivery of an active ingredient to a surface as required, for example, in the treatment of a fungal infection such as athlete's foot. In such an instance, the active ingredient may either be included in the charged particles themselves, or the active ingredient may itself be a charged particle.

In so far as the above outlined advantages are concerned, it is preferred that a charged particle mixture of a single polarity is used. Whilst not wishing to be bound by theory, it is believed that the repulsion between like charged particles aids in both the even distribution of the charged particles on the surface as well as the unique dispersion of the charged particles.

According to another aspect of the invention there is provided an apparatus for delivering electrostatically charged particles to a material, such as carpet or fabric material, the apparatus comprising a) a container, in which particles to be electrostatically charged are stored and b) means for delivering the particles from the container to the carpet or fabric material, the delivery means comprising i) a tube or pipe for delivering the carrier particles to the carpet or fabric material; and ii) means for expelling particles, preferably at high velocity (eq a velocity of 1 to 100 m/sec), from the container to the material;

the tube or pipe being made of such a material that, when carrier particles are passed down the delivery tube at high velocity, a minimum charge to mass ratio of $+/-1\times10^{-4}$ C/kg (preferably from $+/-1\times10^{-4}$ to $+/-1\times10^{-3}$ C/kg) is imparted to the particles by the frictional contact of the particles on the inside of the tube or pipe.

The tube of the apparatus can preferably be made from plastics material, for example perforated polyethylene unperforated and preferably perforated nylon and, unperforated and preferably perforated polytetrafluoroethylene (PTFE) commercially available as Teflon.

Without wishing to be bound by theory, we believe that the preferred tube used is depend ant on the carrier particles to be used. For example if the particles used are towards the positive end of the series, the preferred tube is made of a material towards the negative end of the tribo-electric series and if the particles are towards the negative end of the tribo-electric series, the material of the tube is towards the positive end of the series.

Preferably when the tube is made of perforated polyethylene, the preferred carrier particles are "immobilised tannic acid" as defined above.

Preferably when the tube is made of perforated and unperforated PVC, the preferred carrier particles are selected from nylon, polyvinylpyrrolidone (PVPP), "immobilised tannic acid", maize, calcite treated with oils and celite.

Preferably when the tube is made of perforated and unperforated nylon, the preferred carrier particles are selected from polyester, PVPP, "immobilised tannic acid", cyclodextrin, and calcite, untreated or treated with oils.

Preferably when the tube is made of PTFE, the preferred carrier particles are selected from nylon, PVPP, "immobilised tannic acid", cyclodextrin and calcite, untreated or treated with oils.

Preferably the delivery means include means for expelling particles at high velocity from the container to the material. Such means may be driven by compressed air (i.e. compressor systems such as "puffer" packs or by the use of pressurised gases such as in aerosols). The carrier particles may also be applied to the material by a feed tube that works off the suction effect of a vacuum cleaner, such as a VAX wet and dry vacuum cleaner.

In a yet further aspect the present invention provides apparatus for dispensing charged particles, which apparatus comprises:

a container for housing the particles to be dispensed;

a tube or pipe capable, in use, of imparting to the particles a minimum charge to mass ratio of $+/-1\times10^{-4}$ C/kg by frictional contact of the particles with the inner surface of the tube or pipe; and means for entraining the particles in a stream of gas and directing the stream into the tube or pipe;

wherein the tube or pipe is arranged within the container in order to facilitate frictional charging of the particles by contact, in use, of the particles with the inner surface of the tube

BRIEF DESCRIPTION OF THE DRAWINGS

The present invention will be further described with reference to the accompanying drawings, in which:

FIG. 5 is a graph illustrating the effect of charged particles on preventing dust and other small particles in a carpet becoming airborne, and FIG. 6 is a graph illustrating the effect of charged particles on preventing dust and other small particles becoming airborne from a carpet.

DETAILED DISCLOSURE AND EXAMPLES

Method 1

Figure 1:
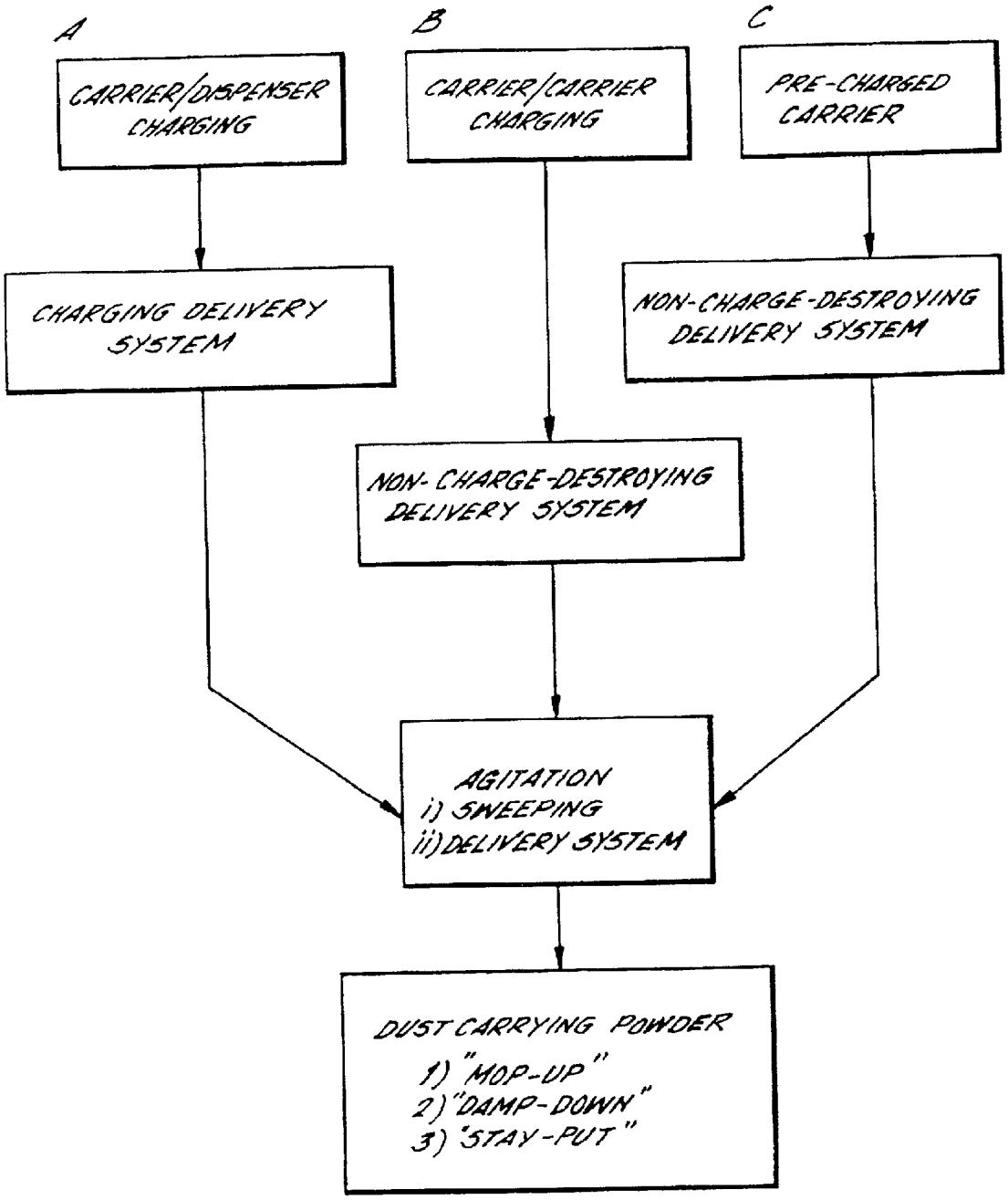
FIG. 1 is a flow diagram illustrating three methods of applying electrostatically charged carrier particles to a material in accordance with the invention.
Figure 2:
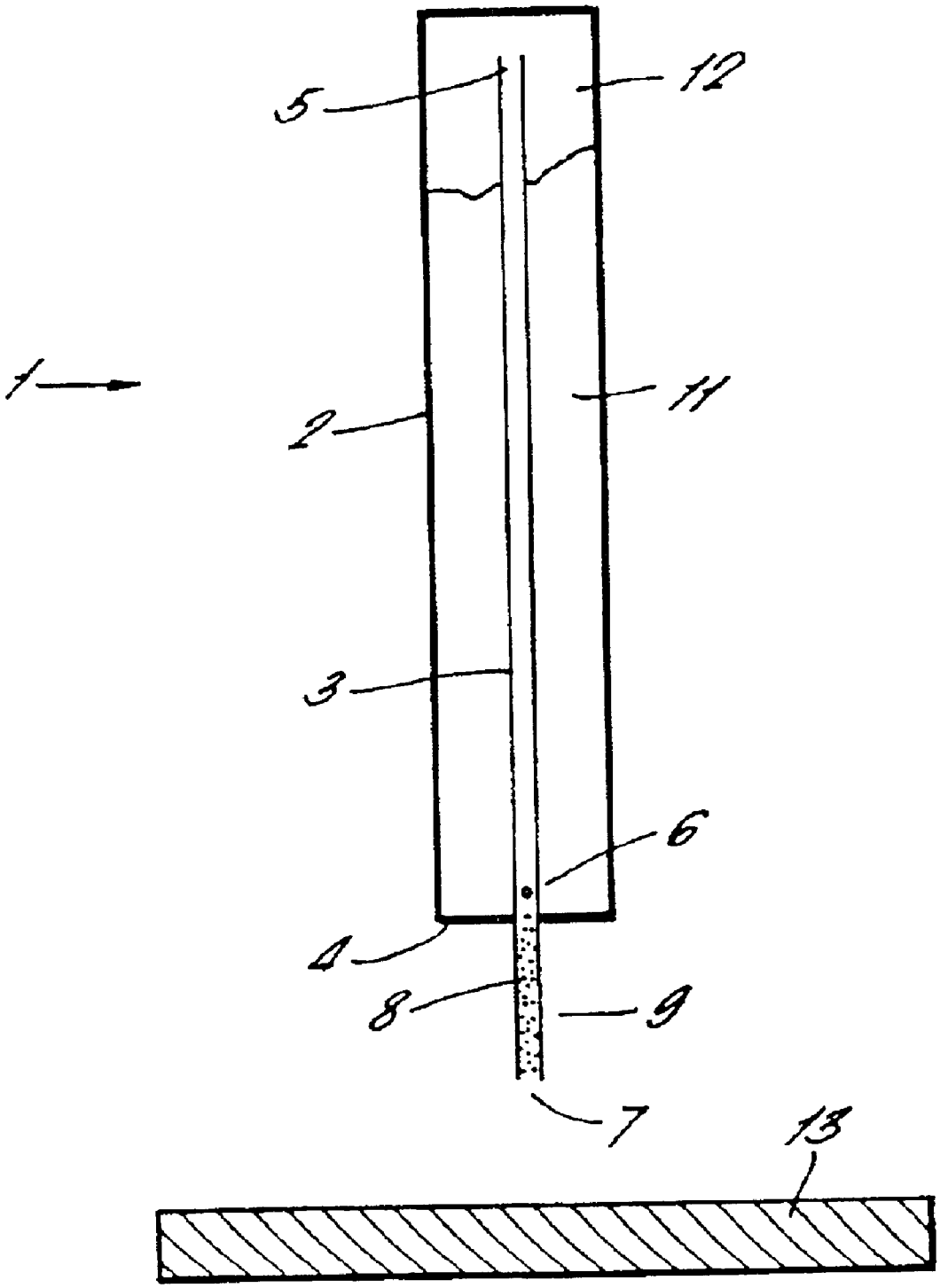
FIG. 2 is a schematic diagram of apparatus for applying charged carrier particles in which the particles are charged during delivery from the apparatus.

In one method of the invention, illustrated in FIG. 1, the carrier particles are stored in the container of a spray device, shown in FIG. 2 and become charged as they are sprayed out from the delivery system via a tribo-electric charging tube of the spray device and applied to the carpet or other material.

Method 2

In a second method of the invention, illustrated in FIG. 1, the carrier particles are made from at least two different particle types and are stored in a segregated container of a device, (not shown). The particles rub against each other as they leave their respective compartments and contact each other thereby becoming charged electrostatically (tribo-electric charging). The particles are dispensed by the delivery system of the container.

Method 3

In a third method of the invention, illustrated in FIG. 1, the carrier particles are pre-charged and then stored in a container of a spray device, shown in FIG. 2. The pre-charged particles are expelled from the container through the delivery system of the container without losing their charge.

In each of the above three methods, when the charged carrier particles are applied to the carpet or other material they may be agitated either by sweeping with a separate brush or by using the end of the tube of the delivery system.

The charged carrier particles agglomerate with dust and other small particles in the carpet or other material and the agglomerates can be removed by a vacuum cleaner or brush. The above described advantages of using the charged carrier particles, "Mop-Up", "Damp Down" and "Stay-Put", occur.

Apparatus 1

An apparatus for delivering charged particles to a material such as a carpet is illustrated in FIG. 2.

Apparatus 1 for dispensing charged carrier particles for application to a carpet comprises a container 2 having flexible walls and a delivery tube 3 which extends from within the container and out through one end wall 4 of the container 2.

The tube 3 is open at the upper end 5 within the container 2, and has an opening 6 in the part of the tube adjacent to the end wall 4 and is open at the lower end 7. The portion of the tube 3 outside the container 2 forms a delivery system and includes holes 8 to form a charging region 9 as described below with reference to FIG. 3

The container 2 contains a mass of carrier particles 11 and a pocket of air 12. If the walls of the container 2 are squeezed, air from the pocket of air 12 will be forced through the open end 5 and down the tube 3 and carrier particles 11 will be forced through the opening 6 into the tube 3. The air moving down the tube 3 will carry the carrier particles with it to the delivery system at the bottom of the tube 3 and will suck more carrier particles into the tube through the opening 6 by a venturi action. As a result, the carrier particles will be carried down the tube 3 into the charging region 9 and become charged as described below. The charged carrier particles 11 will be forced out of the open end 7 of the tube 3 and can be applied to a carpet or other material 13 positioned below the apparatus.

Figure 3:
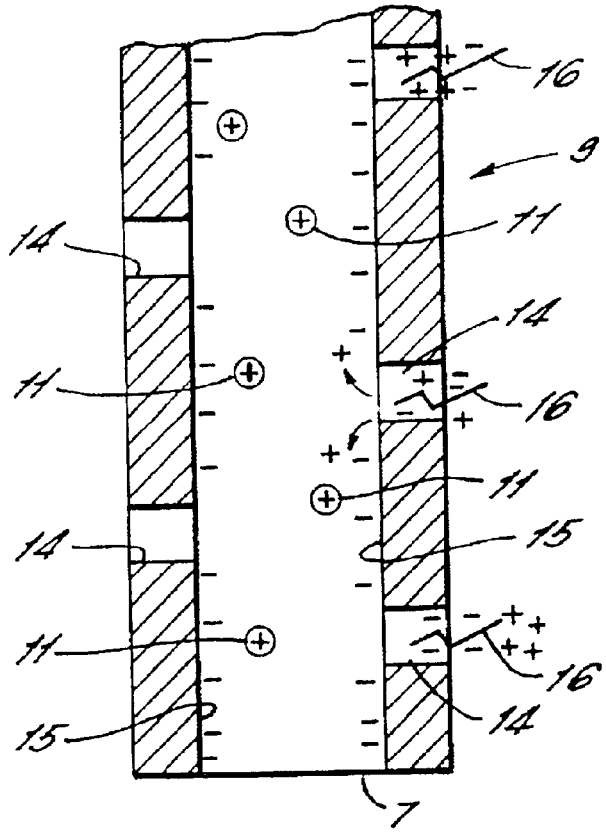
FIG. 3 is a side view, partly in section and to a larger scale, of the delivery system of the apparatus illustrated in FIG. 2.

As illustrated in FIG. 3, the lower end of the tube 3 forming the charging region 9 has holes 14 extending through the walls of the tube 3. The materials of the charging region 9 and of the carrier particles 11 are electrically insulated. Alternatively, the material of the charging region 9 can be semi-insulating, for example an insulating polymer with particles of electrically conducting material distributed therein.

As the carrier particles pass through the charging region 9 the particles become charged to one polarity by the friction between the carrier particles and the inner surface of 15 of the tube 3 (tribo-electric charging) and a charge of the opposite polarity is formed on the inner surface 15. For example, the unipolar charge on the carrier particles 11 may be positive with the charge on the inner surface 15 negative. As the carrier particles 11 continue to pass through the charging region 9, the charge on the inner surface 15 increases. An electric field is generated across the thickness of the wall of the tube 3. As the charge increases, eventually an electrical discharge 16 will occur through one or more of the holes 14.

This will result in the generation of positive and negative ions. The positive ions will tend to combine with the negative charges on the inner surface 15 of the walls to neutralise these negative charges. This electrically regenerates the inner surface, enabling charging of the carrier particles 11 to continue and thereby increasing the level of charge on the carrier particles.

An example of the dimensions of an embodiment of Apparatus 1, illustrated in FIG. 2, is as follows:

the dimensions of the tube 3—outside diameter 4 mm, inside diameter 3 mm, diameter of holes 14—less than 200 microns.

Apparatus 2

As an alternative to generating charged particles by forcing the particles through holes 14 as in Apparatus 1, the charging region 9 of the tube 3 may be formed from microporous material. In this arrangement, the regeneration of the inner surface 15 of the tube 3 takes place by electrical discharge through the micropores.

An example of the dimensions of an embodiment of Apparatus 2, illustrated in FIG. 3 is as follows:

the dimensions of the tube 3—outside diameter 4 mm, inside diameter 3 mm, the distribution of micropores is 600–1000 holes in a tube length of 100 mm.

Apparatus 3

Figure 4:
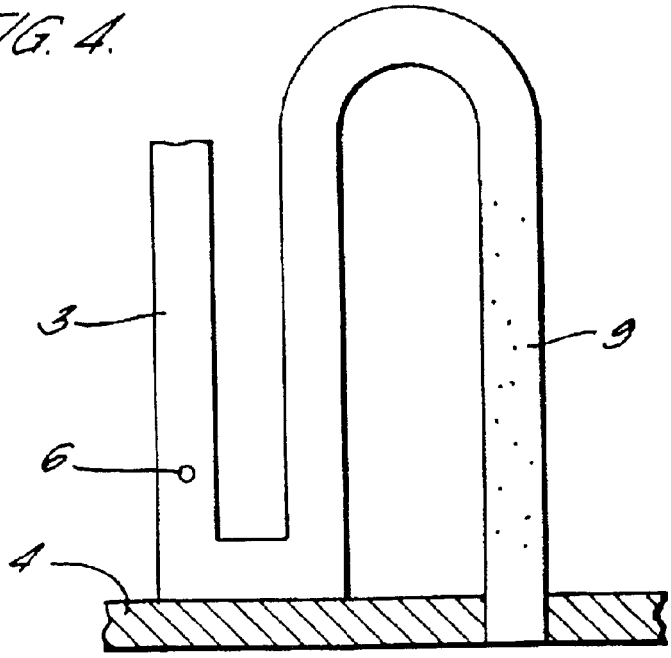
FIG. 4 is a side view, partly in section, of a modified form of the delivery system of the apparatus illustrated in FIG. 2.

An alternative arrangement of the Apparatus 1 is as follows. Such an arrangement is illustrated in FIG. 4. The charging region 9 of the tube 3 is located within the container 2 so that it is protected from damage. The lower end of the tube 3 including the opening 6 abuts the end wall 4 of the container 2. The tube is bent upwards into a loop and then returns downwards to the end wall. The charging region 9 is formed in the downwardly extending portion of the tube. The lower end 7 of the tube 3 extends, flush with the outer surface of the end wall 4 of the container or slightly beyond the end wall.

Apparatus 4

An alternative arrangement for protecting the charging region 9 in Apparatus 3 above is to make the lower end of the tube 3 including the charging region capable of retracting into the portion of the tube 3 within the container 2 or to make it in the form of a bellows.

Apparatus 5

As an alternative to using the apparatus 1 the charged particles may be delivered by a cleaning apparatus, such as a vacuum cleaner. The particles are thereby applied to the carpet surface, agitated so that they agglomerate with the dust or other small particles, and subsequently collected by the cleaning apparatus.

The system of the present invention is envisaged as a dry equivalent of a wet carpet shampoo appliance. In such an arrangement the charged carrier particles would be applied onto the carpet from one nozzle of the appliance and agitated so that the charged carrier particles agglomerate with the dust or other small particles, and then the agglomerates would be removed by a second suction nozzle of the appliance. The removed carrier agglomerates are retained in a collection receptacle.

EXAMPLE 1

In Method 1 described above using Apparatus 1, the carrier particles are Haze Carpet Freshener, lavender perfume (manufactured by Reckitt and Colman Products Limited). In Apparatus 1, a micro-perforated nylon tube is used for the charging region 9 and the level of charge obtained on dispensing the product was such as to produce a charge to mass ratio of $2\times10^{-4}$ C/kg (+ve). The results are shown in FIG. 5. The level of "Damp Down" indicated that, compared to no charged carrier particles being deposited on a sample of carpet, there was approximately 90% less dust airborne above the surface of the carpet when agitated with a vacuum cleaner brush.

EXAMPLE 2

In Method 1 described above using Apparatus 1, the carrier particles are nylon carrier particles. In Apparatus 1 a micro-perforated polyvinylchloride (PVC) tube is used for the charging region 9 of the level of charge obtained on dispensing the product was such as to produce a charge to mass ratio of $2.5\times10^{-4}$ C/kg (+ve). The results are shown in FIG. 6. The level of "Mop Up" indicated that, compared to no charged carrier particles being deposited on a sample of carpet, there was an improvement in dust removal.

In a simulated vacuum cleaning test, using no charged carrier particles, approximately 40% of the dust in the carpet remained in the carpet after a simulated vacuum cleaning test. In the same test using the charged carrier particles, this figure was reduced to approximately 25%.

Examples 1 and 2 may be repeated using each of Apparatuses 2 to 5 above. Alternatively Examples 1 and 2 may be repeated using Methods 2 and 3 above.

What is claimed is:

1. An apparatus for delivering electrostatically charged particles to a carpet or fabric material, the apparatus comprising:

a) a container in which particles to be electrostatically charged are stored; and b) means for delivering the particles from the container to the carpet or fabric material, said means comprising i) a tube or pipe for delivering the carrier particles to the carpet or fabric material, and ii) means for expelling particles at high velocity from the container to the carpet or fabric material, said tube or pipe being made of such a material that, when the particles are passed down the delivery tube or pipe at high velocity, a minimum charge to mass ratio of $\pm1\times10^{-4}$ C/Kg is imparted to said particles by frictional contact on the inside of the tube or pipe.

2. An apparatus according to claim 1 in which the material from which the tube or pipe is made is selected from the group consisting of perforated polyethylene, unperforated and perforated polyvinyl chloride, unperforated and perforated nylon, and unperforated and perforated polytetrafluoroethylene.

3. An apparatus according to claim 2 in which the means for expelling particles at high velocity from the container to the material is compressed air or the suction effect of a vacuum cleaner.

4. An apparatus according to claim 2 in which the wall of the tube or pipe is formed with holes.

5. An apparatus according to claim 2 in which the charging region of the tube or pipe is located within the container.

6. An apparatus according to claim 5 in which the tube or pipe can be stored in the container and moved out of the container for delivering charged particles.

7. A method for controlling and removing dust and other fine particles in a carpet or fabric material comprising the steps of:

providing a container for storing carrier particles;

passing said carrier particles at high velocity through a tube or pipe made of a material such that, as a result of frictional contact between the carrier particles and the inside of said tube or pipe, a minimum charge to mass ratio of $\pm1\times10^{-4}$ C/Kg is imparted to said particles; and expelling the resultant charged carrier particles at high velocity to the carpet or fabric material.

8. A method according to claim 7 in which the tube or pipe is made of perforated polyethylene and the carrier particles are tannic acid immobilized on polyvinylpyrrolidone beads.

9. A method according to claim 7 in which the tube is made of perforated or unperforated polyvinyl chloride and the carrier particles are selected from the group consisting of nylon, polyvinylpyrrolidone, tannic acid immobilized on ponvinylpyrrolidone beads, maize, calcite treated with oils and celite.

10. A method according to claim 7 in which the tube is made of perforated or unperforated nylon and the carrier particles are selected from the group consisting of polyester, polyvinylpyrrolidone, tannic acid immobilized on polyvinylpyrrolidone beads, cyclodextrin, untreated calcite and calcite treated with oils.

11. A method according to claim 7 in which the tube is made of polytetrafluoroethylene and the carrier particles are selected from the group consisting of nylon, polyvinylpyrrolidone, tannic acid immobilized on polyvinylpyrrolidone beads, cyclodextrin, untreated calcite and calcite treated with oils.

12. A method for dispensing charged particles to a surface from a container which contains uncharged particles, which method comprises the steps of:

entraining the uncharged particles in a stream of gas;

directing the stream of gas and entrained particles through a tube or pipe capable of imparting to the particles a minimum charge to mass ratio of $\pm1\times10^{-4}$ C/Kg, by frictional contact of the particles with the inner surface of said tube or pipe; and directing the stream of gas and entrained charged particles to the surface, wherein a mixture of particles of at least two different materials is employed, the particles of a first material being capable of assuming, on charging, a charge of a particular polarity and the particles of a second material being capable of assuming, on charging, a charge of the opposite polarity to that of the first particles.

13. A method according to claim 12 wherein the tube or pipe is arranged within the container.

14. A method according to claim 13 wherein the tube or pipe is arranged in a non-linear fashion.

15. A method according to claim 14 wherein the tube or pipe is formed as a coil.

16. A method for dispensing charged particles to a surface from a container which contains uncharged particles, which method comprises the steps of:

entraining the particles in a stream of gas;

directing the stream of gas and entrained particles through a tube or pipe capable of imparting to the particles a minimum charge to mass ratio of $\pm1\times10^{-4}$ C/Kg, by frictional contact of the particles with the inner surface of said tube or pipe; and directing the stream of gas and entrained charged particles to a surface, wherein the tube or pipe has a plurality of holes which are dimensioned so as to allow for electrical discharge through said holes, but not to allow the velocity of the stream of gas and entrained particles flowing through said holes to be substantially reduced.

17. A method according to claim 16 wherein the holes each have a diameter of less than 5 micrometers.

18. A method according to claim 16 wherein the tube or pipe is arranged within the container.

19. A method according to claim 18 wherein the tube or pipe is arranged in a non-linear fashion.

20. A method according to claim 19 wherein the tube or pipe is formed as a coil.

* * * * *